US005542761A

United States Patent [19]

Dedoes

[11] Patent Number: 5,542,761

[45] Date of Patent: Aug. 6, 1996

[54] AUTOMATIC PAINT STIRRING EQUIPMENT WITH IMPROVED BUSHING

[75] Inventor: John T. Dedoes, Brighton, Mich.

[73] Assignee: Dedoes Industries, Inc., Walled Lake, Mich.

[21] Appl. No.: 530,952

[22] Filed: Sep. 20, 1995

[51] Int. Cl.[6] ..... B01F 7/20

[52] U.S. Cl. ..... 366/198; 366/605

[58] Field of Search ..... 366/197, 198, 366/241–252, 331, 605; 403/349

[56] References Cited

U.S. PATENT DOCUMENTS

| | | | |
|---|---|---|---|
| 2,603,461 | 7/1952 | Marienthal | 366/605 |
| 2,757,910 | 8/1956 | O'Neill | 366/605 X |
| 2,802,649 | 8/1957 | Stockton | 366/605 X |
| 2,965,363 | 12/1960 | Worden | 366/605 X |
| 3,118,653 | 1/1964 | Dedoes | 366/251 X |
| 3,853,414 | 12/1974 | Hirano et al. | 403/349 X |
| 4,133,560 | 1/1979 | Ishikawa et al. | 403/349 X |
| 4,856,910 | 8/1989 | Cuschera | 366/605 |
| 5,160,198 | 11/1992 | Fillon | 366/198 |
| 5,169,232 | 12/1992 | Fillon | 366/299 |

*Primary Examiner*—Charles E. Cooley
*Attorney, Agent, or Firm*—Gifford, Krass, Groh, Sprinkle, Patmore, Anderson & Citkowski, P.C.

[57] ABSTRACT

Automatic paint stirring equipment of the type having a rack adapted to removably receive and support a plurality of paint cans in which each paint can includes a cover having a paint stiffing assembly mounted to the cover with a paddle inside the can and a driven member positioned above the cover. A plurality of drive assemblies are also provided wherein each drive assembly includes a drive shaft rotatably mounted to the rack having a drive member secured to its lower end which mechanically engages the driven member on the paint can cover. A pulley is secured to the other end of the drive shaft while a motor rotatably drives the pulley via an endless belt. The paint stirring equipment includes an improved bushing for rotatably mounting the drive shafts to the rack. This improved bushing includes a one-piece housing having an axial throughbore adapted to receive the drive shaft therethrough. A flange is provided at one end of the bushing while a bayonet coupling is provided at the other end of the bushing. Upon insertion of the bayonet coupling through a like-shaped bayonet opening in the rack and rotation of the bushing to a locked position, a portion of the rack is entrapped between the bayonet coupling and the flange. Preferably, the bushing is of a one-piece plastic construction.

7 Claims, 2 Drawing Sheets

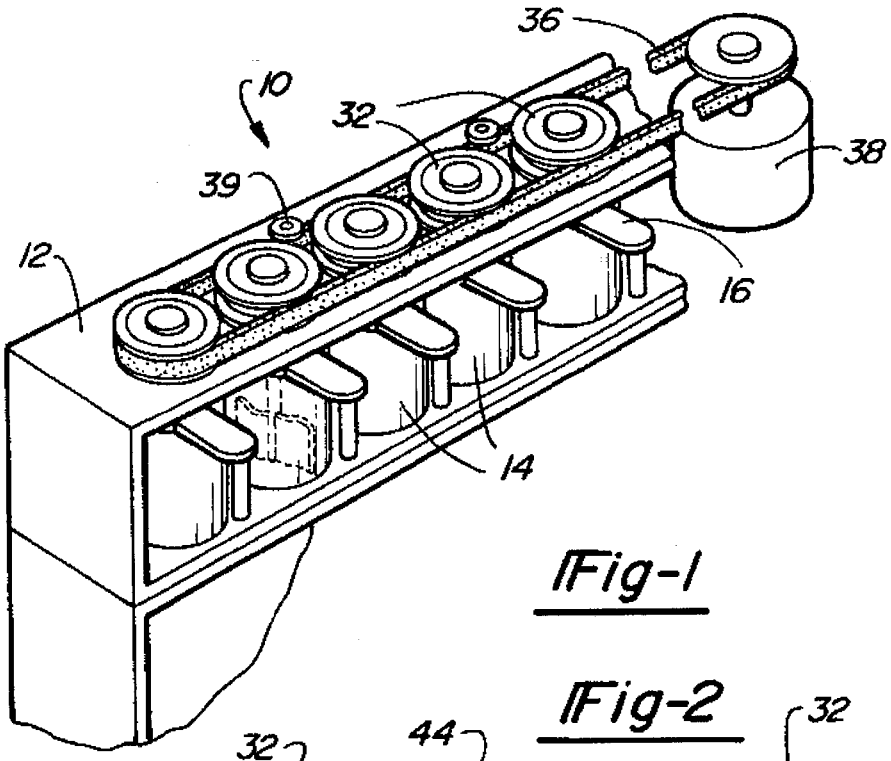
Fig-1
Fig-2
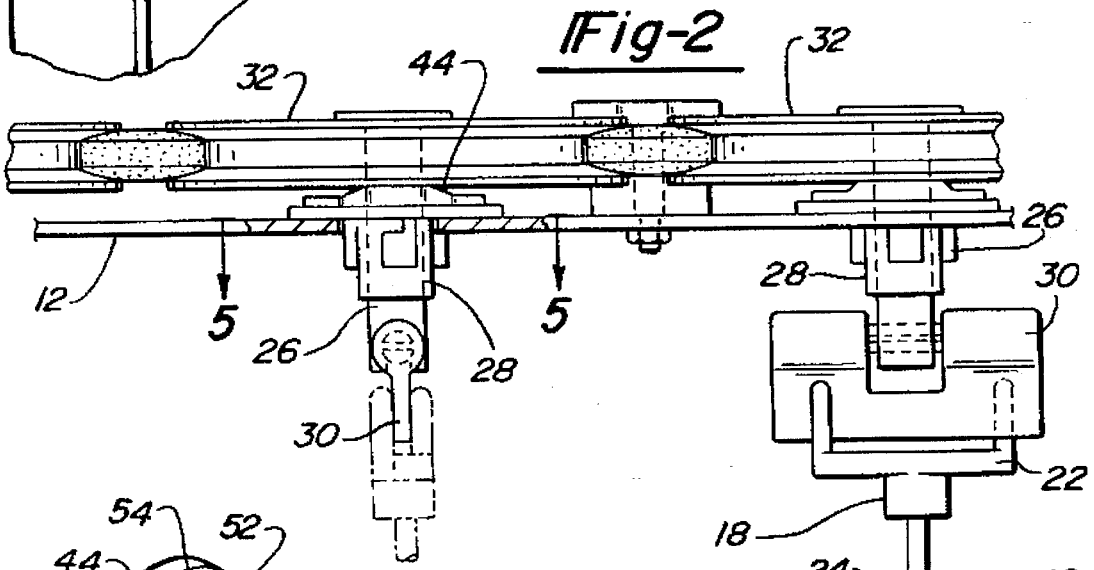
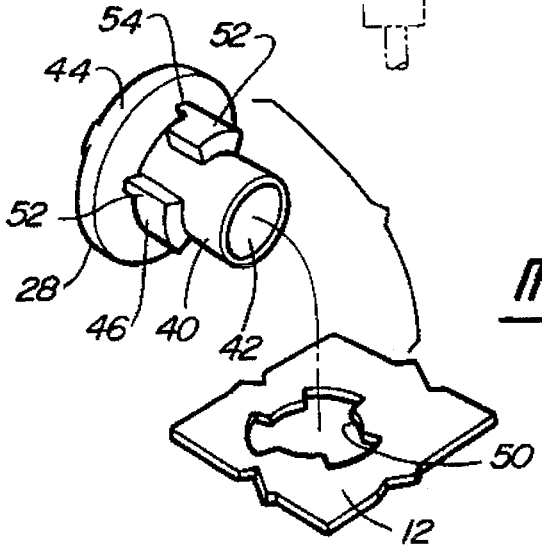
Fig-3

AUTOMATIC PAINT STIRRING EQUIPMENT WITH IMPROVED BUSHING

BACKGROUND OF THE INVENTION

1. Field of the Invention

The present invention relates generally to automatic paint stirring equipment and, more particularly, to such equipment with an improved bushing assembly.

2. Description of the Prior Art

There are many types of previously known automatic paint stirring equipment of the type commonly used in automotive repair shops. The previously known automatic paint stirring equipment typically comprises a rack designed to removably receive and support a plurality of cans of paint.

A cover assembly is disposed across the open top of each paint can. Each cover assembly, furthermore, includes a stirring mechanism with a paddle positioned inside the paint can, a driven member positioned above the cover and a shaft which connects the driven member to the paddle. Furthermore, upon insertion of the paint can with its cover into the rack, a drive member mounted to the rack automatically mechanically engages the driven member on the paint can cover. Thus, rotation of the drive member simultaneously rotates the driven member and its attached paddle thus stirring the paint in the desired fashion.

These previously known drive mechanisms typically comprise a drive shaft which is rotatably mounted to the rack and has a first or lower end positioned adjacent the driven member on the paint can cover as well as an upper end. A drive member is secured to the lower end of the drive shaft for mechanically engaging the driven member of the stirring assembly on the paint can cover. Conversely, a pulley is secured to the upper end of the drive shaft and this pulley is rotatably driven in a preset rotational direction by a motor.

In order to rotatably mount the drive shaft to the rack, the previously known automatic paint stirring equipment has typically employed a metal bushing which is secured to the rack by drilling holes through portions of the metal bushing and then securing the bushing to the rack with sheet metal screws. These previously known bushings are thus disadvantageous tier a number of different reasons.

One disadvantage of these previously known bushings is that the bushings were relatively expensive to construct both in material and machining costs. Furthermore, the necessity of drilling holes through the bushing further increased the manufacturing costs for the bushing.

A still further disadvantage of these previously known bushings is that it was relatively difficult and time consuming to attach the bushing to the rack with the sheet metal screws. This further increased the overall labor costs of assembly of the paint. stirring equipment.

A still further disadvantage of the previously known bushings is that, after prolonged use, the screw securing the bushings to the rack would become loosened and require periodic maintenance for retightening. Failure to properly maintain the maintenance of the bushings could result in failure of the bushing and failure of the paint stirring equipment.

SUMMARY OF THE PRESENT INVENTION

The present invention provides automatic paint stirring equipment which overcomes all of the above-mentioned disadvantages of the previously known devices.

In brief, the automatic paint stirring equipment of the present invention comprises a rack adapted to removably receive and support a plurality of paint cans. Each paint can includes a cover having a paint stirring assembly mounted to the cover. The paint stirring assembly includes a paddle contained within the interior of the can and a driven member positioned above the cover and mechanically connected to the paddle by a shaft.

A plurality of drive assemblies are rotatably mounted to the rack for rotatably driving the paint stirring assemblies positioned on the rack. Each drive assembly includes a drive shaft which is positioned through a bushing secured to the rack. A drive member is secured to a lower end of the drive shaft which mechanically drivingly engages the driven member on the paint can cover. A drive pulley is secured to the upper end of the drive shall while a motor rotatably drives the pulley in a predetermined rotational direction thus stirring the paint in the can in the desired fashion.

The bushing for rotatably mounting the drive shaft to the rack is preferably of a one-piece plastic body which is generally cylindrical in shape and has a flange at one end. An axially extending through bore is provided through the bushing for rotatably receiving the drive shaft therethrough while a bayonet coupling is provided at the other end of the bushing. The bayonet coupling is inserted through a bayonet opening in the rack and rotated to a locked position whereupon a portion of the rack is entrapped between the bayonet coupling and the flange.

BRIEF DESCRIPTION OF THE DRAWING

A better understanding of the present invention will be had upon reference to the following detailed description, when read in conjunction with the accompanying drawing, wherein like references refer to like characters throughout the several views, and in which:

FIG. 1 is a fragmentary elevational view illustrating a portion of a preferred embodiment of the present invention;

FIG. 2 is a side view illustrating a portion of the preferred embodiment of the present invention;

FIG. 3 is an exploded diagrammatic view illustrating the preferred embodiment of the present invention;

DETAILED DESCRIPTION OF A PREFERRED EMBODIMENT OF THE PRESENT INVENTION

Figure 4:
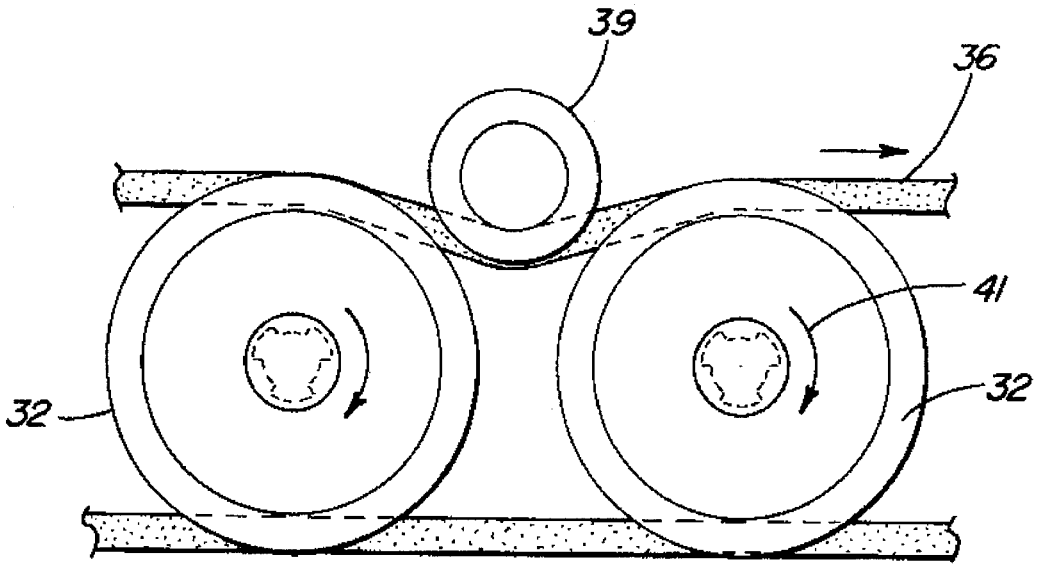
FIG. 4 is a fragmentary top view illustrating a preferred embodiment of the present invention.

With reference first to FIGS. 1 and 2, a preferred embodiment of the paint stirring equipment 10 of the present invention is thereshown and comprises a rack 12 adapted to removably receive and support a plurality of paint cans 14 (FIG. 1) in a side-by-side relationship.

A cover 16 is provided across the open top of each paint can 14. As best shown in FIG. 2, each cover assembly 16 includes a stirring assembly 18 having a paddle 20 positioned within the interior of the can 14, a driven member 22 positioned above the cover 16 and means, such as a shaft 24, for connecting the driven member 22 to the paddle 20.

As best shown in FIG. 2, a plurality of drive shafts 26 are each rotatably mounted by a bushing 28 to the rack 12 so that the drive shafts 26 are spaced apart and parallel to each other. Furthermore, a drive member 30 is secured to a lower end of each drive shall 26 such that, with the paint can 14 positioned within the rack 12, the drive: member 30 and driven member 22 are mechanically connected together.

With reference now to FIGS. 1, 2 and 4, a drive pulley 32 is secured to the upper end of each drive shaft 26 so that each drive pulley 32 rotates in unison with its associated drive shaft 26. Furthermore, as best shown in FIG. 1, the drive pulleys 32 are generally coplanar and aligned with each other.

With reference now to FIGS. 1 and 4, a conventional motor 38 is drivingly connected to the drive pulleys 32 by an endless flexible belt 36. Appropriate idler wheels 39 are provided between drive pulleys 36 to ensure adequate frictional engagement between the belt 36 and the drive pulleys 32 such that the drive pulleys 32 rotate in unison with the movement of the drive belt 36. Furthermore, as best shown in FIG. 4, the drive pulleys 32 are rotatably driven in a preset rotational direction as indicated by arrow 41.

With reference now particularly to FIG. 3, the bushing 28 is thereshown in greater detail and generally comprises a cylindrical body 40 having an axial throughbore 42. The axial throughbore 42 is dimensioned to slidably receive the drive shall 26 therethrough.

An enlarged diameter flange 44 is provided around an upper end of the body 40 and the flange 44 is generally circular in shape. A bayonet coupling 46 is also formed on the body 40 adjacent its other end. This bayonet coupling 46 is dimensioned to be insertably received through a bayonet opening 50 in the rack 12.

Although the bayonet coupling 46 may be of any conventional construction, in the preferred embodiment, it includes three pins 52 which extend radially outwardly from the bushing body 40 at a position spaced from the flange 44. The three pins 52 are circumferentially equidistantly spaced from each other. Additionally, a stop member 54 extends between the flange 44 on one side of each pin 52.

Figure 5:
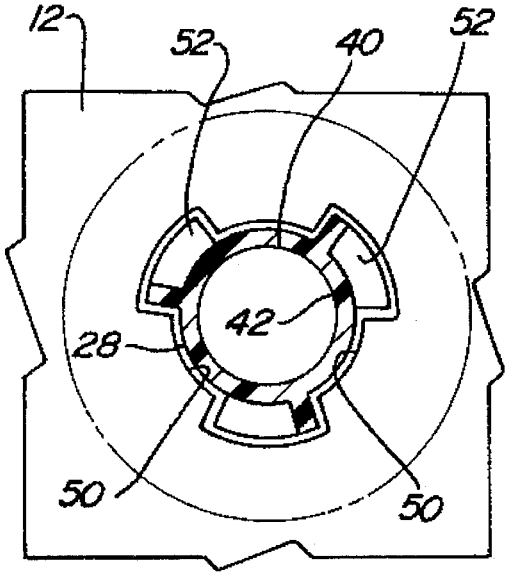
FIG. 5 is a sectional view taken substantially along line 5—5 in FIG. 2 and illustrating the bushing in an unlocked position.

With reference now particularly to FIG. 5, the bushing 28 is thereshown positioned through the opening 50 in the rack 12 so that each pin 52 is received through a corresponding portion of the opening 50. In doing so, the flange 28 abuts against an upper side of the rack 12 (see FIG. 2) while the pins 52 of the bayonet coupling 46 are positioned on the opposite side of the rack 12.

Figure 6:
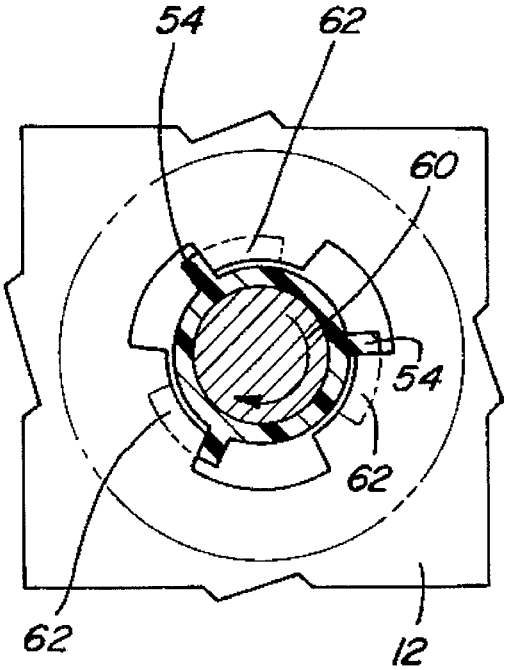
FIG. 6 is a view similar to FIG. 5 but illustrating the bushing in a locked position.

With reference now to FIG. 6, after the bushing is inserted through the bayonet opening 50 in the rack, the bushing is rotated in the direction indicated by arrow 60 to the position shown in FIG. 6. In doing so, a portion 62 is entrapped between the pins 52 of the bayonet coupling 46 and the bushing flange 44 thus securing the bushing 28 to the rack 12. The stop members 54 on the bushing 28 limit the rotation of the bushing in the direction of arrow 60.

With reference now to FIGS. 4 and 6, the direction of rotation 41 of the drive pulley 32 is the same as the direction of rotation 60 of the bushing 28 necessary to move the bushing 28 to a locked position. Consequently, rotation of the drive pulleys 32 during the normal operation of the paint stirring equipment 10 ensures that the bushing 28 remains seated in its locked position (FIG. 6) to the rack 12.

In practice, in order to assemble the bushings 28 to the rack 12, the bushings 28 are merely inserted through the bayonet openings 50 in the rack 12 and rotated to their locked position (FIG. 6). As such, the bushings 28 can be easily and rapidly assembled to the rack 12.

In the preferred embodiment of the invention, each bushing is of a one-piece construction. Furthermore, the bushings 28 are also preferably constructed from an inexpensive, yet durable plastic material. The plastic material may be oil impregnated to minimize wear and tear on the drive shafts 26.

From the foregoing, it can be seen that the present invention provides automatic paint stirring equipment with an improved bushing assembly. Having described my invention, however, many modifications thereto will become apparent to those skilled in the art to which it pertains without deviation from the spirit of the invention as defined by the scope of the appended claims.

I claim:

1. Automatic paint stirring equipment comprising a rack adapted to removably receive and support a plurality of paint cans, each paint can having a cover and a paint stiffing assembly mounted to the cover, said paint stirring assembly having a paddle positioned within the paint can and a driven member positioned above the cover and mechanically connected to the paddle by a shaft, a plurality of drive assemblies, each drive assembly having a drive shaft, means for rotatably mounting each drive assembly to said rack, a drive member secured to one end of said drive shaft, said drive member being mechanically drivingly connected to the driven member of the paint stirring assembly of one paint can positioned in the rack, a plurality of drive pulleys, one drive pulley being secured to the other end of each drive shaft, a motor, means for drivingly connecting said motor to said drive pulleys so that actuation of said motor rotatably drives said drive pulleys, wherein said rotatable mounting means comprises a bushing having a throughbore adapted to receive said drive shaft, said bushing having a flange at one end and a bayonet coupling at its other end, said bayonet coupling being insertable through a bayonet opening in said rack so that, upon rotation of said bushing to a locked position, a portion of said rack is sandwiched between said flange and said bayonet coupling.

2. The invention as defined in claim 1 wherein said bushing is of a one piece construction.

3. The invention as defined in claim 2 wherein said bushing is made of plastic.

4. The invention as defined in claim 1 wherein said bayonet coupling comprises a plurality of pins extending radially outwardly with respect to said bushing throughbore.

5. The invention as defined in claim 4 wherein said pins are spaced from said flange by a distance substantially the same as a thickness of said rack at said bayonet opening.

6. The invention as defined in claim 5 wherein said bushing includes a stop extending between one side of each pin and said flange.

7. The invention as defined in claim 4 wherein said plurality of pins comprises three pins.

* * * * *

UNITED STATES PATENT AND TRADEMARK OFFICE

CERTIFICATE OF CORRECTION

PATENT NO. : 5,542,761

DATED : August 6, 1996

INVENTOR(S) : John T. Dedoes

It is certified that error appears in the above-indentified patent and that said Letters Patent is hereby corrected as shown below:

Abstract, line 4, "stiffing" should be --stirring--.

Column 1, line 43, "tier" should be --for--.

Column 1, line 54, delete "." after "paint".

Column 2, line 16, "shall" should be --shaft--.

Column 3, line 5, "shall" should be --shaft--.

Column 3, line 6, delete ":" after "drive".

Column 3, line 28, "shall" should be --shaft--.

Column 4, line 21, "stiffing" should be --stirring--.

Signed and Sealed this

Seventh Day of January, 1997

*Attest:*

Bruce Lehman

BRUCE LEHMAN

*Attesting Officer*

*Commissioner of Patents and Trademarks*